US010796829B2

(12) United States Patent
Cho

(10) Patent No.: US 10,796,829 B2
(45) Date of Patent: Oct. 6, 2020

(54) COIL ELECTRONIC COMPONENT

(71) Applicant: SAMSUNG ELECTRO-MECHANICS CO., LTD., Suwon-Si, Gyeonggi-Do (KR)

(72) Inventor: Jung Ho Cho, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 74 days.

(21) Appl. No.: 16/004,110

(22) Filed: Jun. 8, 2018

(65) Prior Publication Data

US 2019/0122794 A1 Apr. 25, 2019

(30) Foreign Application Priority Data

Oct. 24, 2017 (KR) ..... 10-2017-0138342

(51) Int. Cl.

| | |
|---|---|
| ***H01F 1/34*** | (2006.01) |
| ***H01F 27/32*** | (2006.01) |
| ***H01F 41/12*** | (2006.01) |
| ***H01F 27/28*** | (2006.01) |
| ***H01F 41/04*** | (2006.01) |
| ***B22F 5/00*** | (2006.01) |

(Continued)

(52) U.S. Cl.

CPC ..... *H01F 1/344* (2013.01); *B22F 3/1007* (2013.01); *B22F 5/00* (2013.01); *B22F 5/106* (2013.01); *B22F 7/008* (2013.01); *C22C 30/02* (2013.01); *C22C 30/06* (2013.01); *C22C 38/002* (2013.01); *C22C 38/08* (2013.01); *C22C 38/16* (2013.01); *H01F 17/0013* (2013.01); *H01F 27/2804* (2013.01); *H01F 27/29* (2013.01); *H01F 27/292* (2013.01); *H01F 27/323* (2013.01); *H01F 41/041* (2013.01); *H01F 41/046* (2013.01); *H01F 41/122* (2013.01); *B22F 2201/03* (2013.01); *B22F 2301/35* (2013.01); *B22F 2999/00* (2013.01); *C22C 33/0285* (2013.01); *H01F 2027/2809* (2013.01)

(58) Field of Classification Search

CPC .... H01F 27/323; H01F 27/2804; H01F 27/29; H01F 1/344

USPC ..... 336/200, 232

See application file for complete search history.

(56) References Cited

U.S. PATENT DOCUMENTS

| | | | | |
|---|---|---|---|---|
| 8,164,410 | B2 | 4/2012 | Tanaka et al. | |
| 2002/0114962 | A1 * | 8/2002 | Kawasaki | C04B 35/265 428/469 |

(Continued)

FOREIGN PATENT DOCUMENTS

| | | | |
|---|---|---|---|
| JP | 04323806 | A * | 11/1992 |
| JP | 09249933 | A * | 9/1997 |

(Continued)

*Primary Examiner* — Tszfung J Chan

(74) *Attorney, Agent, or Firm* — Morgan, Lewis & Bockius LLP

(57) ABSTRACT

A coil electronic component includes a body including a plurality of insulating layers and coil patterns disposed on the insulating layers, and external electrodes formed on an external surface of the body and connected to the coil patterns. The plurality of insulating layers include a Ni—Cu—Zn based ferrite, and the Ni—Cu—Zn based ferrite has a content of Ni within a range from 5 to 15%, a content of Cu within a range from 5 to 10%, and a content of Zn within a range from 28 to 35% based on a mole ratio.

9 Claims, 5 Drawing Sheets

(51) Int. Cl.

| | |
|---|---|
| ***B22F 7/00*** | (2006.01) |
| ***C22C 30/06*** | (2006.01) |
| ***C22C 30/02*** | (2006.01) |
| ***C22C 38/16*** | (2006.01) |
| ***C22C 38/08*** | (2006.01) |
| ***C22C 38/00*** | (2006.01) |
| ***H01F 27/29*** | (2006.01) |
| ***B22F 3/10*** | (2006.01) |
| ***H01F 17/00*** | (2006.01) |
| ***B22F 5/10*** | (2006.01) |
| *C22C 33/02* | (2006.01) |

(56) References Cited

U.S. PATENT DOCUMENTS

2006/0045839 A1* 3/2006 Takagawa ..... C04B 35/2658
423/594.1
2010/0271163 A1* 10/2010 Nakamura ..... B32B 18/00
336/200
2011/0291784 A1* 12/2011 Nakatsuji ..... H01F 17/0013
336/192
2013/0126264 A1* 5/2013 Takenoshita ..... C04B 35/2658
181/175
2014/0035714 A1* 2/2014 Lee ..... H01F 3/08
336/233
2014/0097927 A1* 4/2014 Yamamoto ..... H01F 1/344
336/200

FOREIGN PATENT DOCUMENTS

JP 2006182633 A * 7/2006
JP 6065439 B2 1/2017

* cited by examiner

COIL ELECTRONIC COMPONENT

CROSS-REFERENCE TO RELATED APPLICATION(S)

This application claims the benefit of priority to Korean Patent Application No. 10-2017-0138342 filed on Oct. 24, 2017 in the Korean Intellectual Property Office, the disclosure of which is incorporated herein by reference in its entirety.

BACKGROUND

1. Field

The present disclosure relates to a coil electronic component.

2. Description of Related Art

An inductor, which is a type of coil electronic component, is a component that may be used in an electronic circuit, together with a resistor and a condenser, and is used as a component for removing noise or forming an LC resonance circuit. In this case, the inductor may be classified as having one of various forms such as a multilayer inductor, a winding inductor, a thin film inductor, and the like, depending on a form of a coil.

The multilayer inductor implements inductance by a method for forming coil patterns with a conductive paste on an insulating sheet formed of a magnetic substance as a main material and stacking the coil patterns to form a coil in a multilayer sintered body. A representative magnetic substance is a Ni—Cu—Zn based ferrite. It is known that maximally obtainable permeability of the Ni—Cu—Zn based ferrite is a level of 1200. However, in a case in which internal electrodes and the ferrite are simultaneously sintered, the ferrite should be sintered at a relatively low temperature. As a result, it is difficult to substantially implement theoretical permeability of the Ni—Cu—Zn based ferrite.

Regulations for low frequency noise from 1 KHz to 300 KHz have recently been tightened. Such a trend is intensified in the field of automobile parts and the like and may be coped with by improving permeability of the multilayer inductor.

In order to secure high permeability, a Mn—Zn based ferrite is used. However, the Mn—Zn based ferrite has a large change in characteristics depending on the temperature and it is may not be easy to meet a co-fired condition with a metal.

SUMMARY

An aspect of the present disclosure may provide a coil electronic component capable of improving characteristics such as permeability and the like in a multilayer coil electronic component using a Ni—Cu—Zn based ferrite.

According to an aspect of the present disclosure, a coil electronic component may include a body including a plurality of insulating layers and coil patterns disposed on the insulating layers; and external electrodes formed on an external surface of the body and connected to the coil patterns, wherein the plurality of insulating layers include a Ni—Cu—Zn based ferrite, and the Ni—Cu—Zn based ferrite has a content of Ni of 5 to 15%, a content of Cu of 5 to 10%, and a content of Zn of 28 to 35% based on a mole ratio.

An average size of crystal grains of the Ni—Cu—Zn based ferrite may be 10 μm or more.

The average size of crystal grains of the Ni—Cu—Zn based ferrite may be 10 μm or more and 20 μm or less.

The Ni—Cu—Zn based ferrite may have permeability of 1500 or more.

The Ni—Cu—Zn based ferrite may be sintered in oxygen partial pressure of 1% to 5%.

A content of iron (Fe) in the Ni—Cu—Zn based ferrite may be 45% to 55% based on the mole ratio.

The Ni—Cu—Zn based ferrite may not contain a sintering preparation component.

The Ni—Cu—Zn based ferrite may not contain V, Bi or Si.

A plurality of coil patterns may be formed to be stacked.

The coil electronic component may further include a plurality of conductive vias connecting the plurality of coil patterns to each other.

The coil patterns may include silver (Ag).

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments of the present disclosure will be described in detail with reference to the accompanying drawings.

Figure 1:
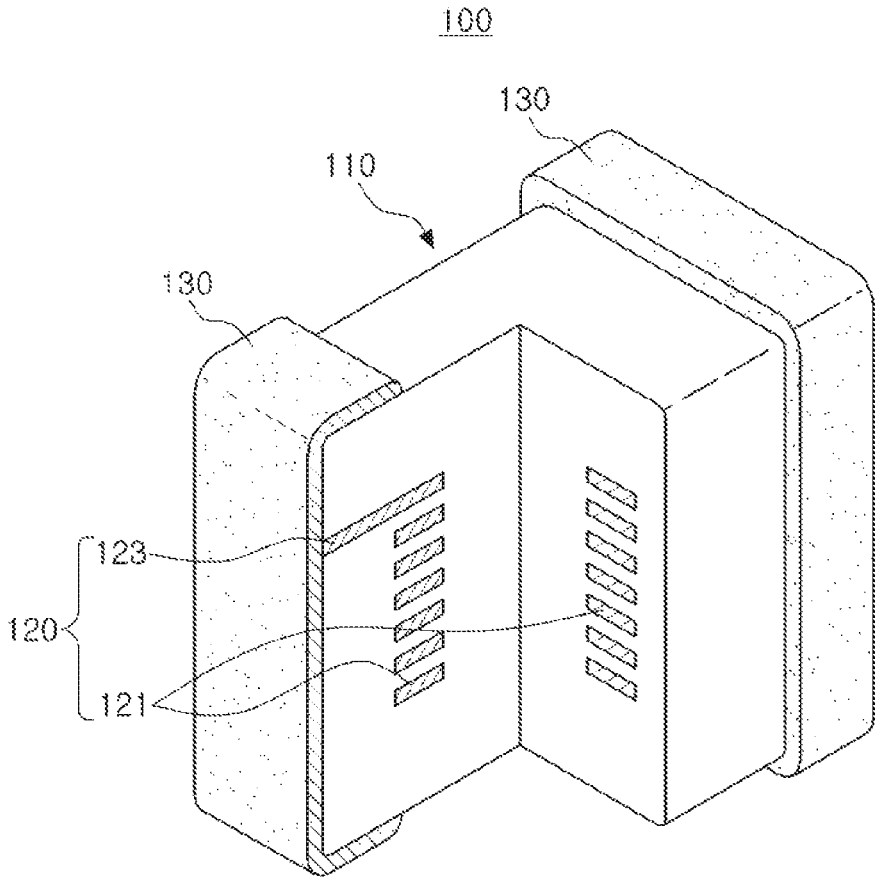
FIG. 1 is a perspective view schematically illustrating a coil electronic component according to an exemplary embodiment in the present disclosure, in which an internal coil pattern is exposed.
Figure 2:
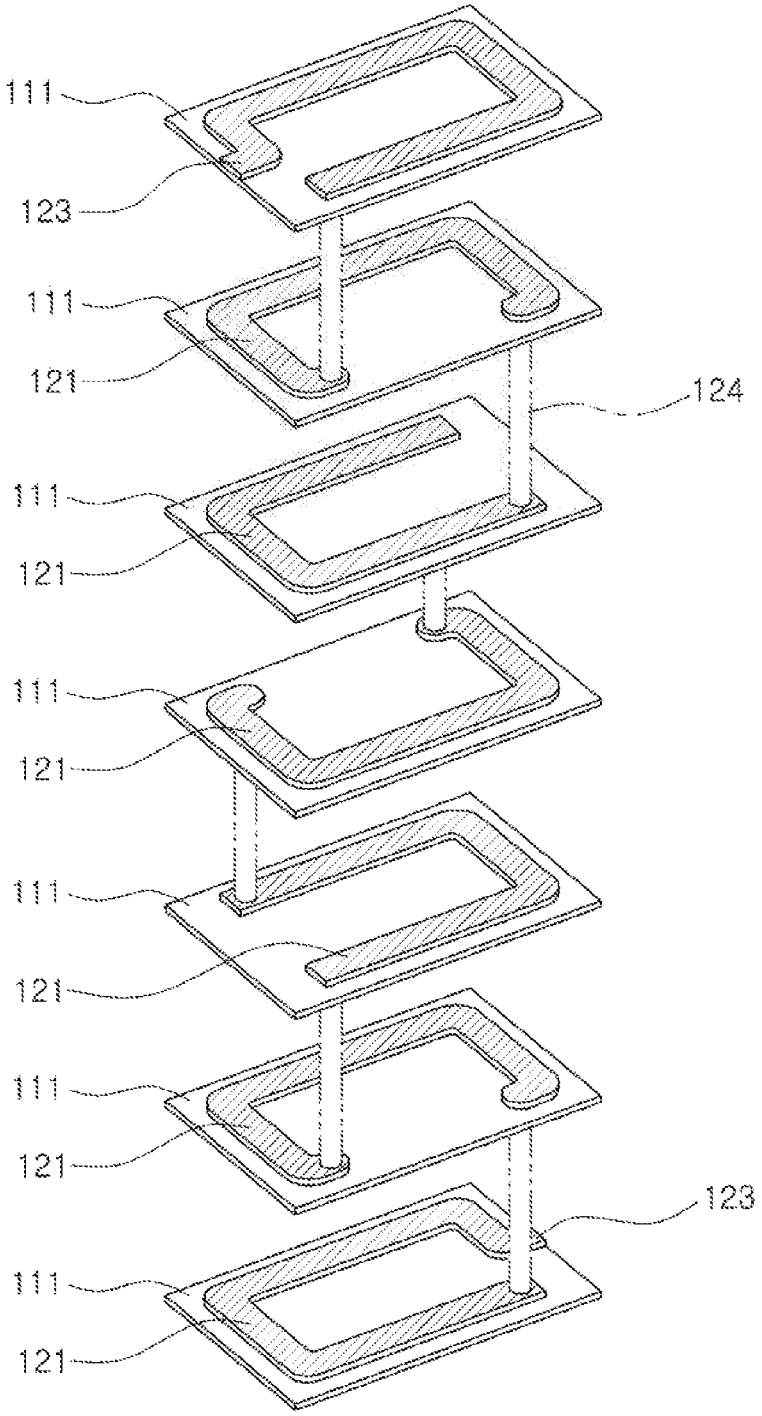
FIG. 2 illustrates forms of the coil patterns in the coil electronic component of FIG. 1 according to an exemplary embodiment in the present disclosure.
Figure 3:
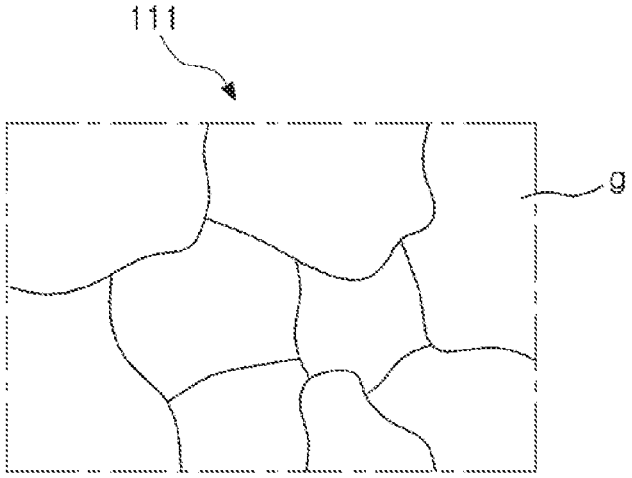
FIG. 3 schematically illustrates a form of crystal grains that an insulating layer employed in the coil electronic component of FIG. 1 may have.

FIG. 1 is a perspective view schematically illustrating a coil electronic component according to an exemplary embodiment in the present disclosure, in which an internal coil pattern is exposed. FIG. 2 illustrates forms of the coil patterns in the coil electronic component of FIG. 1 according to an exemplary embodiment in the present disclosure. In addition, FIG. 3 schematically illustrates a form of crystal grains that an insulating layer employed in the coil electronic component of FIG. 1 may have.

Referring to FIGS. 1 and 2, a coil electronic component 100 according to the present exemplary embodiment may have a structure including a body 110, a coil part 120, and external electrodes 130. A plurality of insulating layers 111 configuring the body 110 may include a Ni—Cu—Zn based ferrite. Hereinafter, the respective components configuring the coil electronic component 100 will be described.

The body 110 may include the plurality of insulating layers 111 and the coil part 120 disposed on the plurality of insulating layers 111. The plurality of insulating layers 111 configuring the body 110 may be a sintered body of the Ni—Cu—Zn based ferrite. The coil part 120 may include a plurality of coil patterns 121 which are stacked, and the coil patterns 121 may forma form of a spiral coil according to a stacked direction. In this case, the coil patterns 121 formed at different levels may be connected to each other by conductive vias 124. In addition, the coil part 120 may include leading parts 123 which are led externally from the body 110 in order to connect the coil patterns 121 disposed on the uppermost and lowest portions of the insulating layers to the external electrodes 130. The leading parts 123 may be formed by using the same material and the same process as the coil patterns 121.

The coil patterns 121 may be formed by printing a conductive paste including a conductive metal on the plurality of insulating layers 111 at a predetermined thickness. The conductive metal forming the coil patterns 121 is not particularly limited as long as it is a metal having excellent electrical conductivity. For example, the conductive metal may be one of silver (Ag), palladium (Pd), aluminum (Al), nickel (Ni), titanium (Ti), gold (Au), copper (Cu), platinum (Pt), and the like, or a mixture thereof. In a case in which the coil pattern 121 includes silver (Ag) having a low melting point, since a sintering temperature of the Ni—Cu—Zn based ferrite included in the insulating layer 111 needs to be lowered, there is a limitation to increase permeability of the Ni—Cu—Zn based ferrite. According to the present exemplary embodiment, even in a case in which the coil patterns 121 including silver (Ag) are sintered at a low temperature, a high level of permeability may be obtained by adjusting a composition and a size of the crystal grain of the Ni—Cu—Zn based ferrite.

The external electrodes 130 may be formed on an external surface of the body 110 to be connected to the coil patterns 121, and may be connected to the leading parts 123 as illustrated in FIG. 1. The external electrodes 130 may be formed of a metal having excellent electrical conductivity, for example, one of nickel (Ni), copper (Cu), tin (Sn), or silver (Ag), or an alloy thereof.

As described above, according to the present exemplary embodiment, the insulating layer 111 may include the Ni—Cu—Zn based ferrite. According to the research of the inventors, high permeability of about 1500 or more may be implemented while not increasing the sintering temperature by adjusting the size of the crystal grain in the Ni—Cu—Zn based ferrite of a certain composition range to be relatively large. The Ni—Cu—Zn based ferrite may have a content of Ni within a range from 5 to 15%, a content of Cu within a range from 5 to 10%, and a content of Zn within a range from 28 to 35% based on a mole ratio of the Ni—Cu—Zn based ferrite. When the Ni—Cu—Zn based ferrite has the above-mentioned composition range, it was confirmed that a crystal growth of the ferrite is accelerated in a low oxygen partial pressure condition. In addition, iron (Fe), which is a main component in the Ni—Cu—Zn based ferrite, may have a content within a range from 45 to 55% based on a mole ratio of the Ni—Cu—Zn based ferrite. In a case in which the composition range and the sintering condition proposed by the present exemplary embodiment are satisfied, even though a sintering preparation component is not separately added, a crystal grain g of the ferrite may be formed to be large due to excellent sinterability. Accordingly, the Ni—Cu—Zn based ferrite may not contain a sintering preparation component. Representative examples of the sintering preparation component may include V, Bi, and Si components, which are generally added in the form of $V_2O_5$, $Bi_2O_3$, and $SiO_2$, respectively. However, when the sintering preparation component is added, permeability may be decreased. In consideration of this, the sintering preparation component is not used in the Ni—Cu—Zn based ferrite according to the present exemplary embodiment. For example, the Ni—Cu—Zn based ferrite according to the present exemplary embodiment may not contain V, Bi or Si.

Referring to FIG. 3, as the crystal growth is accelerated, the crystal grain g of the Ni—Cu—Zn based ferrite may be formed to be larger than the conventional crystal grain. Specifically, an average size of the crystal grains may be 10 μm or more. More specifically, the average size of the crystal grains of the Ni—Cu—Zn based ferrite may be within a range from 10 μm or more to 20 μm or less. Such an average size of the crystal grains is significantly larger than a size of the crystal grain of the conventional Ni—Cu—Zn based ferrite, which is generally about 1 to 2 μm, and about 4 to 5 μm even when a liquid sintering preparation component is added. Here, the size of the crystal grain may be defined as an equivalent circle diameter obtained by measuring an area of a separate crystal grain and converting the area into a diameter of a circle having the same area.

Figure 4:
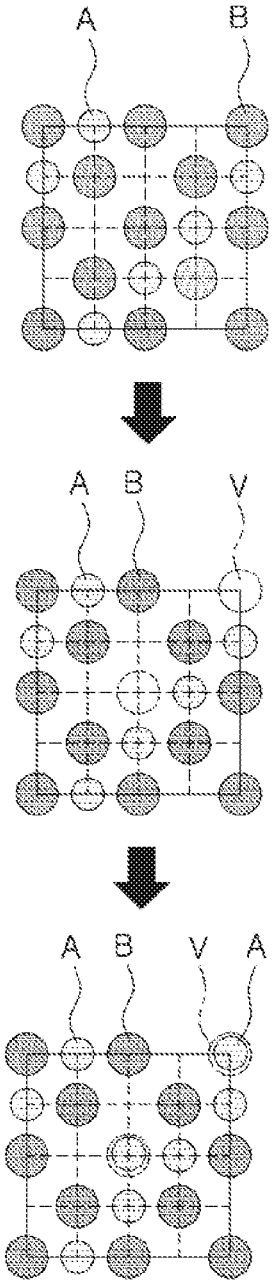
FIG. 4 is a view illustrating a sintering behavior of a Ni—Cu—Zn ferrite in low oxygen atmosphere conditions.
Figure 5:
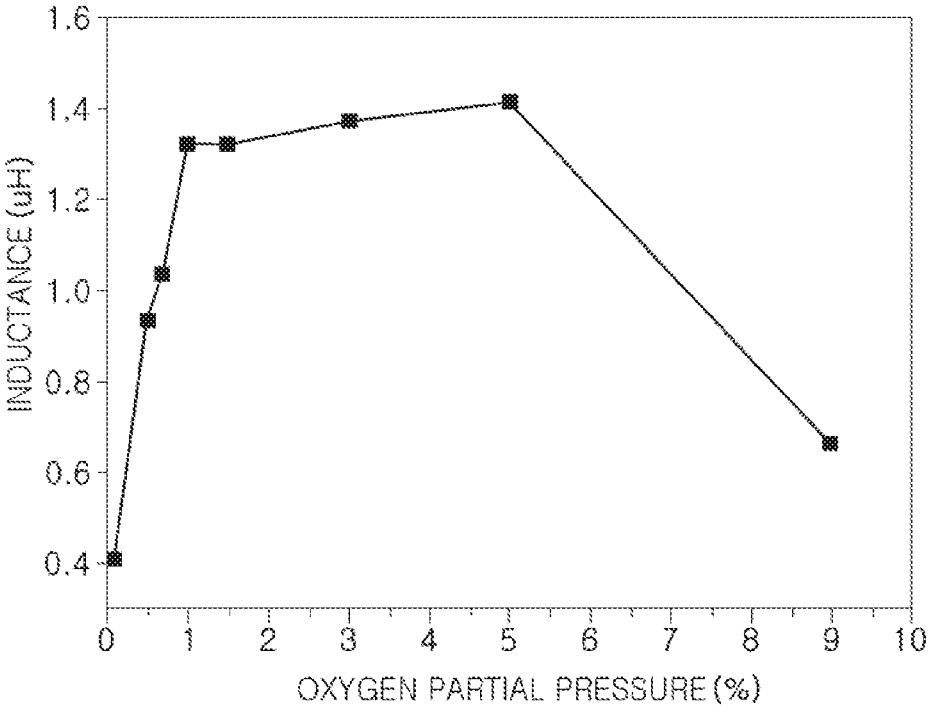
FIGS. 5 and 6 illustrate results obtained by measuring inductance and RX cross frequency characteristics of the Ni—Cu—Zn based ferrite which is sintered at different oxygen partial pressures.
Figure 6:
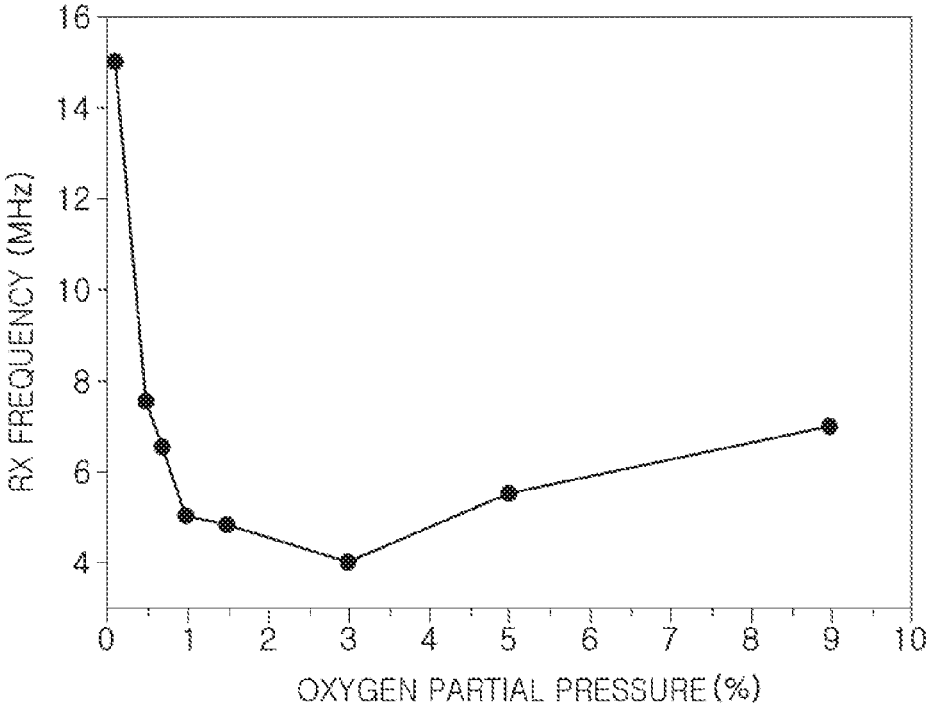

When the Ni—Cu—Zn based ferrite having the composition range described above is sintered in a low oxygen partial pressure condition, the crystal growth thereof may be accelerated and the size of the crystal grain thereof may be increased. This will be described with reference to FIGS. 4 through 6. FIG. 4 is a view illustrating a sintering behavior of a Ni—Cu—Zn based ferrite in low oxygen atmosphere conditions. FIGS. 5 and 6 illustrate results obtained by measuring inductance and RX cross frequency characteristics of the Ni—Cu—Zn based ferrite which is sintered at different oxygen partial pressures. Here, the RX cross frequency is a frequency at which resistance R and inductance X of the Ni—Cu—Zn based ferrite are equal to each other and generally shows a tendency to be inversely proportional to permeability of the material.

Referring to FIG. 4, in a case in which the Ni—Cu—Zn based ferrite is sintered in a low oxygen partial pressure condition, voids V may occur at positions of oxygen, which is a negative ion B, and a positive ion A such as Zn, Ni, Cu, or the like may be substituted for the voids. Accordingly, diffusion driving force of ions is increased in the low oxygen partial pressure, such that high sinterability may be secured at a low temperature. In addition, referring to graphs of FIGS. 5 and 6, it may be confirmed that inductance and permeability are increased in the Ni—Cu—Zn based ferrite which is sintered in an atmosphere having an oxygen partial pressure within a range from about 1% to 5%. Unlike the present exemplary embodiment, when the Ni—Cu—Zn based ferrite having the same composition is sintered (about 920° C.) in atmosphere, the average size of the crystal grains is a level of 0.5 to 1.5 μm, and a desired level of permeability may not be obtained.

As described above, when a multilayer inductor is implemented using the Ni—Cu—Zn based ferrite having the composition range and the average size of the crystal grains proposed by the exemplary embodiment described above, since sinterability may be improved, co-firing with the metal forming the coil patterns may be possible and a high level of permeability may be obtained. Such a multilayer inductor may be effectively used as a component for removing low frequency noise of 1 MHz or less and may be applied to various applications requiring high permeability characteristics.

As set forth above, according to the exemplary embodiments in the present disclosure, when the coil electronic component is used, a high level of permeability may be implemented, and the low frequency noise characteristic and the like may be thus improved.

While exemplary embodiments have been shown and described above, it will be apparent to those skilled in the art that modifications and variations could be made without departing from the scope of the present invention as defined by the appended claims.

What is claimed is:

1. A coil electronic component comprising:

a body including a plurality of insulating layers and coil patterns disposed on the insulating layers; and external electrodes formed on an external surface of the body and connected to the coil patterns, wherein the plurality of insulating layers include a Ni—Cu—Zn based ferrite, the Ni—Cu—Zn based ferrite has a content of Ni within a range from 5 to 15%, a content of Cu within a range from 5 to 10%, and a content of Zn within a range from 28 to 35%, based on a mole ratio of the Ni—Cu—Zn based ferrite, an average size of crystal grains of the Ni—Cu—Zn based ferrite is 10 μm or more and 20 μm or less, and the Ni—Cu—Zn based ferrite does not contain Bi.

2. The coil electronic component of claim 1, wherein the Ni—Cu—Zn based ferrite has a permeability of 1500 or more.

3. The coil electronic component of claim 1, wherein the Ni—Cu—Zn based ferrite is sintered in an atmosphere having an oxygen partial pressure within a range from 1% to 5%.

4. The coil electronic component of claim 1, wherein a content of iron (Fe) in the Ni—Cu—Zn based ferrite is within a range from 45% to 55%, based on the mole ratio of the Ni—Cu—Zn based ferrite.

5. The coil electronic component of claim 1, wherein the Ni—Cu—Zn based ferrite does not contain a sintering preparation component.

6. The coil electronic component of claim 1, wherein the Ni—Cu—Zn based ferrite does not contain V or Si.

7. The coil electronic component of claim 1, wherein the plurality of insulating layers and the coil patterns are stacked.

8. The coil electronic component of claim 7, further comprising a plurality of conductive vias electrically connecting the coil patterns to each other.

9. The coil electronic component of claim 1, wherein the coil patterns include silver (Ag).

* * * * *